US010568466B2

(12) United States Patent
Hawkins

(10) Patent No.: US 10,568,466 B2
(45) Date of Patent: Feb. 25, 2020

(54) SHOWERHEAD ASSEMBLY WITH SUPPLEMENTAL WALL MOUNTED SHOWERHEAD

(71) Applicant: FAN FI INTERNATIONAL, INC., Reno, NV (US)

(72) Inventor: Travis Hawkins, Reno, NV (US)

(73) Assignees: FAN FI INTERNATIONAL, INC.; ETL, LLC, Reno, NV (US)

( * ) Notice: Subject to any disclaimer, the term of this patent is extended or adjusted under 35 U.S.C. 154(b) by 16 days.

(21) Appl. No.: 15/996,794

(22) Filed: Jun. 4, 2018

(65) Prior Publication Data

US 2019/0365160 A1 Dec. 5, 2019

(51) Int. Cl.
*A47K 3/28* (2006.01)

(52) U.S. Cl.
CPC ..... *A47K 3/28* (2013.01)

(58) Field of Classification Search
CPC ..... A47K 3/28; B05B 1/1636; B05B 1/18
USPC ..... 239/282, 443, 444, 446, 560–562
See application file for complete search history.

(56) References Cited

U.S. PATENT DOCUMENTS 1,120,341 A 12/1914 Smith
3,112,073 A * 11/1963 Larson ..... E03C 1/0408 239/446
3,375,532 A * 4/1968 Gellmann ..... E03C 1/06 4/570
3,817,247 A 6/1974 Mills
5,093,942 A 3/1992 Lang
5,678,258 A 10/1997 Healy
6,415,461 B1 7/2002 Singer
7,299,510 B2 * 11/2007 Tsai ..... E03C 1/023 239/283
9,242,259 B2 1/2016 Jeronimus
10,232,384 B2 * 3/2019 Hawkins ..... B65H 75/4478
2004/0237186 A1 12/2004 Petrovic et al.
2008/0185456 A1 8/2008 McCabe

* cited by examiner

*Primary Examiner* — Christopher S Kim
(74) *Attorney, Agent, or Firm* — David Duckworth

(57) ABSTRACT

A showerhead assembly is provided having a diverter, a primary showerhead and a wall mounted supplemental showerhead. The showerhead assembly's diverter includes a female threaded inlet for affixing to a male threaded pipe, a first outlet, a second outlet, and a valve assembly which selectively permits or obstructs the flow of water through the first and second outlets. The primary showerhead is connected to the diverter's first outlet by a ball and socket joint connector, and the supplemental showerhead is connected to the diverter's second outlet by a hollow flexible hose. The supplemental showerhead is affixed to a shower stall wall by a fastener, such as a male threaded fastener, hook and pile, adhesive, magnets or the like.

10 Claims, 8 Drawing Sheets

SHOWERHEAD ASSEMBLY WITH SUPPLEMENTAL WALL MOUNTED SHOWERHEAD

BACKGROUND OF THE INVENTION

The present invention relates to showerheads. More particularly, the present invention relates to handheld showerheads producing a plurality of spray patterns.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central conduit connected to one or more spray jets directed to produce a constant pattern. The stationary spray showerheads cause water to flow through the construction to contact essentially the same points on a user's body in a repetitive fashion.

Multifunction showerheads are able to deliver water in many different spray patterns such as a fine spray, a coarse spray, a pulsating spray, or even a flood pattern providing high fluid flow but decreased velocity. Of course, many other spray patterns may also be provided.

A conventional multifunction showerhead generally requires the user to turn a selector ring or dial on the showerhead faceplate in order to select a desired function. Another approach is to provide a faceplate with several spray jets located in concentric circular patterns. An internal controller, such as controlled by buttons or the like, may be operated to direct the incoming water to any of the various patterns. Examples of such constructions are disclosed in U.S. Pat. Nos. 5,433,384 and 6,622,945.

Unfortunately, these conventional multifunction controllers suffer from various drawbacks. For example, turning a ring or pushing a button adjacent to the showerhead can be difficult to perform by persons having soapy hands. Furthermore, the showerhead's spray still originates at basically the same location, and thus does not provide a user with the ability to vary where the spray comes from.

A handheld showerhead typically includes a hollow handle connected to a water supply by a flexible rubber hose. Handheld showerheads allow a person to adjust the location and angle of the spray head, and thus where the spray originates and where the spray goes. However, handheld showerheads suffer other problems. In addition to having the above-described drawbacks of it being difficult to rotate a selector dial or push a button with soapy hands, a person holding the handheld showerhead must utilize one's hands to hold the showerhead which can make it difficult for a person to apply soap or shampoo.

More recently, shower stalls have been provided with a primary showerhead, and additional nozzles which project directly from the shower stall's sidewalls and which spray water in different directions than the primary showerhead. Unfortunately, these constructions require that expensive plumbing additions be made to the shower stall facility. Further, the sidewall nozzles cannot be moved to provide the variety that would be desirable for a shower user.

Recently gaining in popularity, shower stalls have been provided with rain showerheads. Typically, rain showerheads are mounted to pipes which project from the shower stall ceiling. The rain showerhead's face is aligned to point straight down and the nozzles are configured to provide a soft rain feature. Unfortunately, this ceiling mounted construction requires unusual plumping installations that can be expensive. Furthermore, once the plumbing has been installed, the rain showerhead cannot be inexpensively moved to provide the variety that would be desirable for a shower user.

Thus, it would further be advantageous to provide a showerhead assembly that included a primary showerhead as well as one or more supplemental showerhead which can be located at different locations within a shower stall.

Further, it would be advantageous to provide a showerhead assembly that included nozzles that could be moved throughout a shower stall, including upon the ceiling and sidewalls, which did not require expensive modifications to the traditional shower stall architecture such as the introduction of additional plumbing within the walls of the shower stall. As defined herein, the term "wall" is intended to be interpreted broadly to include both a sidewall or a ceiling. Accordingly, the phrase "shower stall walls" is intended to include both the shower stall's sidewalls and ceiling.

SUMMARY OF THE INVENTION

Briefly, in accordance with the invention, an improved showerhead assembly is provided including a primary showerhead, a supplemental showerhead, a fluid diverter, a hollow flexible hose, and a fastener for affixing the supplemental showerhead to a shower stall wall. Preferably, the primary showerhead has a relatively traditional construction including a showerhead body having a central conduit for transporting water to one or more spray nozzles for spraying water. The primary showerhead may have control knobs or levers for diverting water to different nozzles such as to provide different spray patterns.

The primary showerhead is connected to a water source by the diverter which includes a housing having a central cavity. Furthermore, the diverter includes an inlet which is preferably female threaded for connecting to a male threaded pipe providing a water source. In addition, the diverter includes a first outlet and a second outlet for dispersing water. Preferably, the diverter incorporates a valve assembly for manually controlling the flow of water received from the inlet so as to permit or obstruct the flow of water through the first outlet and second outlet. In a preferred embodiment, the valve assembly includes a cylinder which is rotatable by a knob. The cylinder includes channels which can be rotated to align with the inlet and first outlet and/or second outlet so as to convey water through the valve assembly diverter so as to be expelled through the first outlet and/or second outlet.

The shower assembly's supplemental showerhead includes a housing and hollow passageway. In addition, the supplemental showerhead includes one or more nozzles connected to the passageway for spraying water. Preferably, the supplemental showerhead's nozzles are connected to the passageway by ball and socket joint connectors which permits the nozzle's multidirectional pivoting relative to the supplemental showerhead's housing.

The showerhead assembly's primary showerhead is connected to the diverter's first outlet, and the showerhead assembly's supplemental showerhead is connected to the diverter's second outlet. Preferably, the primary showerhead is connected to the diverter's first outlet by a ball and socket joint connector which permits the primary showerhead to pivot multidirectionally relative to the diverter. Meanwhile, the supplemental showerhead is connected to the diverter's second outlet by the hollow flexible hose.

The showerhead assembly further includes a fastener for affixing the supplemental showerhead to the ceiling or sidewall of a shower stall. The fastener can be constructed in various forms as can be determined by those skilled in the art. Preferred fasteners include male threaded screws which project through holes formed in the supplemental showerhead's housing, as well as hook and loop, magnet and adhesive fasteners.

To install the showerhead assembly of the present invention within a shower stall, the diverter is connected to a traditional male threaded pipe by connecting the diverter's female threaded inlet to the male threaded end of the pipe. The supplemental showerhead is affixed to the shower stall wall utilizing a fastener such as screws, hook and loop, adhesive, or magnets. Advantageously, the primary showerhead can be pivoted so as to spray water in the direction desired. Similarly, the supplemental showerhead nozzles can also be pivoted to spray water in a desired direction from a different location.

Therefore, it is an object to provide a showerhead assembly which includes a primary showerhead connected to a traditional pipe found in a shower stall, as well as a supplemental showerhead which can be located upon the ceiling or sidewall of a shower stall.

It is still an additional object of the invention to provide a showerhead assembly that provides a showerhead which can be installed at different locations within a shower stall without modifying the existing plumbing typically found in a shower stall comprising a single male threaded pipe.

These and other more specific advantages will be apparent to those skilled in the art from the following description taken in conjunction with the drawings.

DETAILED DESCRIPTION OF THE INVENTION

Figure 1:
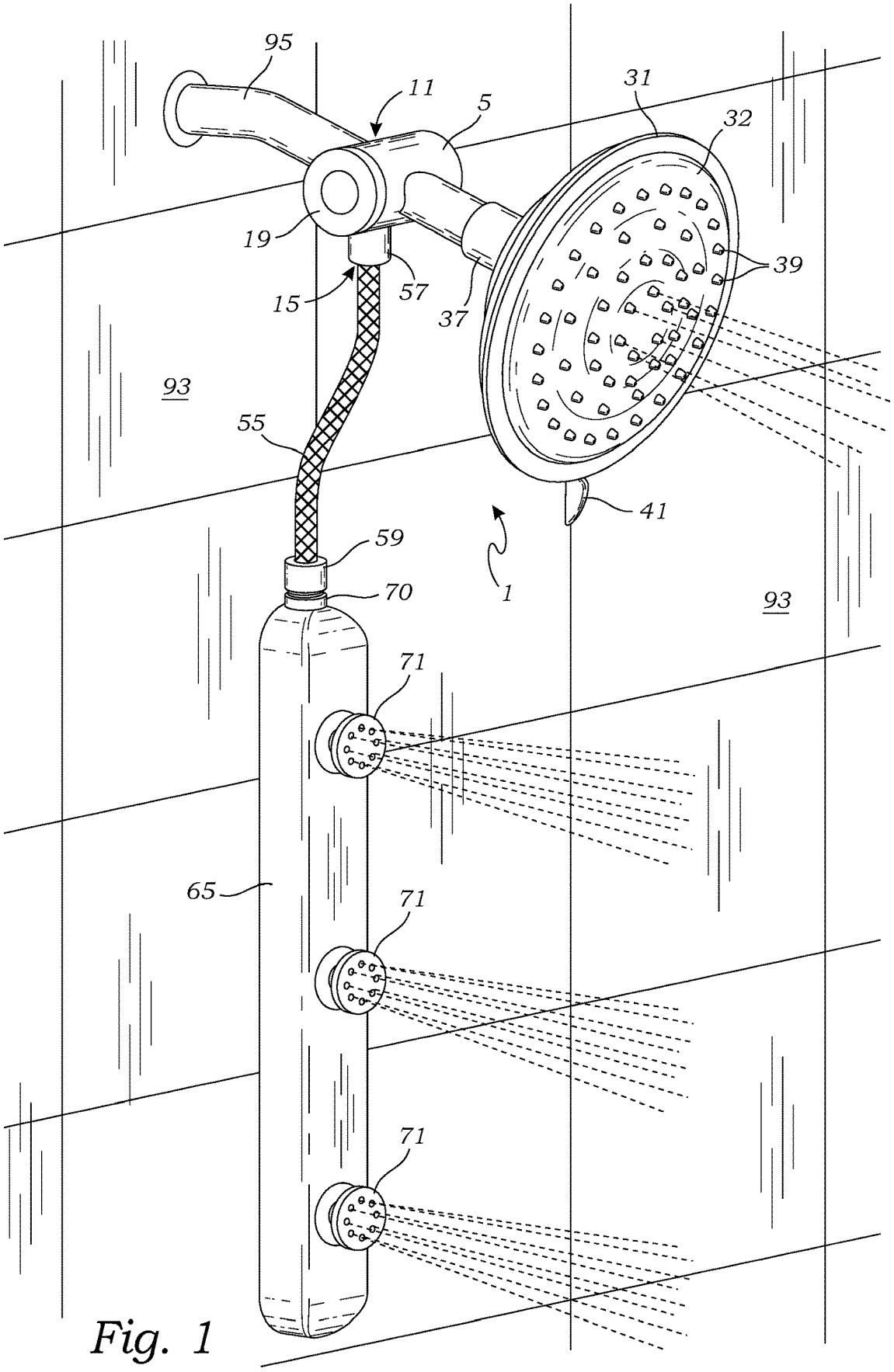
FIG. 1 is a first perspective view of the showerhead assembly with a supplemental showerhead sidewall mounted to a sidewall in a first orientation.

While the present invention is susceptible of embodiment in various forms, as shown in the drawings, hereinafter will be described the presently preferred embodiments of the invention with the understanding that the present disclosure is to be considered an exemplification of the invention, and the present disclosure is not intended to limit the invention to specific embodiments illustrated.

With reference to FIGS. 1-14, the showerhead assembly 1 includes a diverter 5, a primary showerhead 31 and a supplemental showerhead 65. As best illustrated in FIGS. 1, 2 and 9-11, the diverter 5 includes a housing 7 and a central cavity 9. Furthermore, the diverter includes a female threaded inlet 11 for permitting the inflow of water into the diverter's central cavity, as well as to the first outlet 13 and second outlet 15. Preferably, the diverter's inlet 11 is female threaded and sized to mate to the male threads of a traditional pipe 95 which typically projects from a shower stall wall 93.

Figure 9:
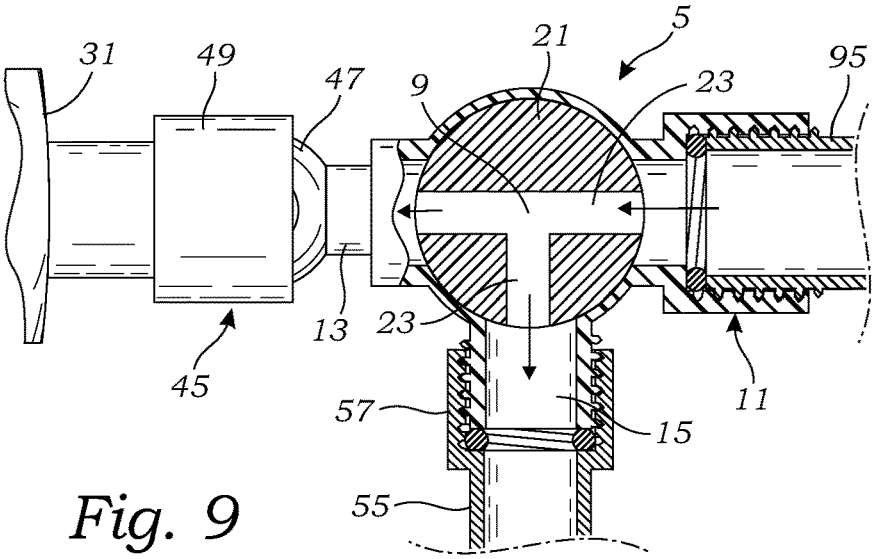
FIG. 9 is a side cutaway view of the diverter illustrating the valve rotated to allow water to flow from the diverter's inlet through the diverter's first and second outlets.
Figure 10:
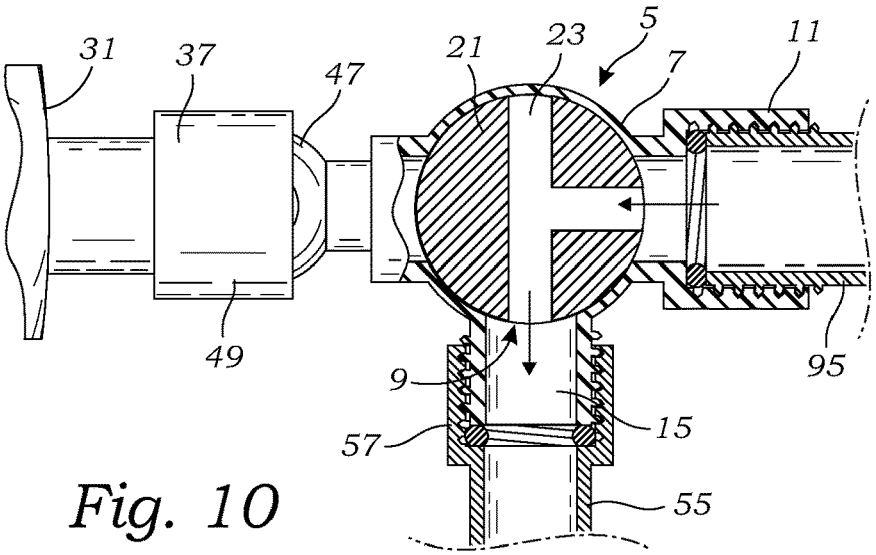
FIG. 10 is a side cutaway view of the diverter illustrating the valve rotated to allow water to flow from the diverter's inlet through the diverter's second outlet, but not first outlet.
Figure 11:
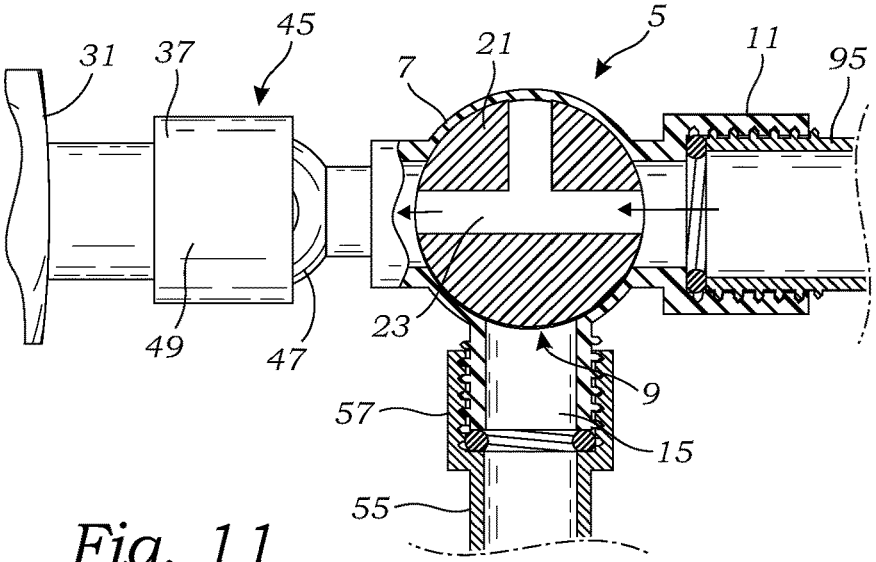
FIG. 11 is a side cutaway view of the diverter illustrating the valve rotated to allow water to flow from the diverter's inlet through the diverter's first outlet, but not second outlet.

In addition, the diverter 5 includes a valve assembly 17 within the diverter's central cavity 9 which selectively permits or obstructs the flow of water to the first outlet 13 and/or second outlet 15. As best illustrated in FIGS. 9-11, a preferred valve assembly 17 includes a cylinder 21 within a cylindrically shaped central cavity 9. This cylinder includes channels 23 which can be rotated so as to obstruct the flow of water through the diverter 5, or permit the flow of water to the first outlet 13, second outlet 15, or both. For example, FIG. 9 illustrates the valve assembly's cylinder 21 rotationally positioned so as to allow water received through inlet 11 to pass through the channels 23 to both the first outlet 13 and second outlet 15. Meanwhile, FIG. 10 illustrates the valve assembly's cylinder rotated, such as by the manual rotation of knob 19, to a position where water is capable of flowing only to the second outlet 15. Finally, FIG. 11 illustrates the valve assembly's cylinder 21 rotated so that the channels are aligned to permit the passage of water from the inlet 11 only to the first outlet 13, but not to the second outlet 15.

Figure 2:
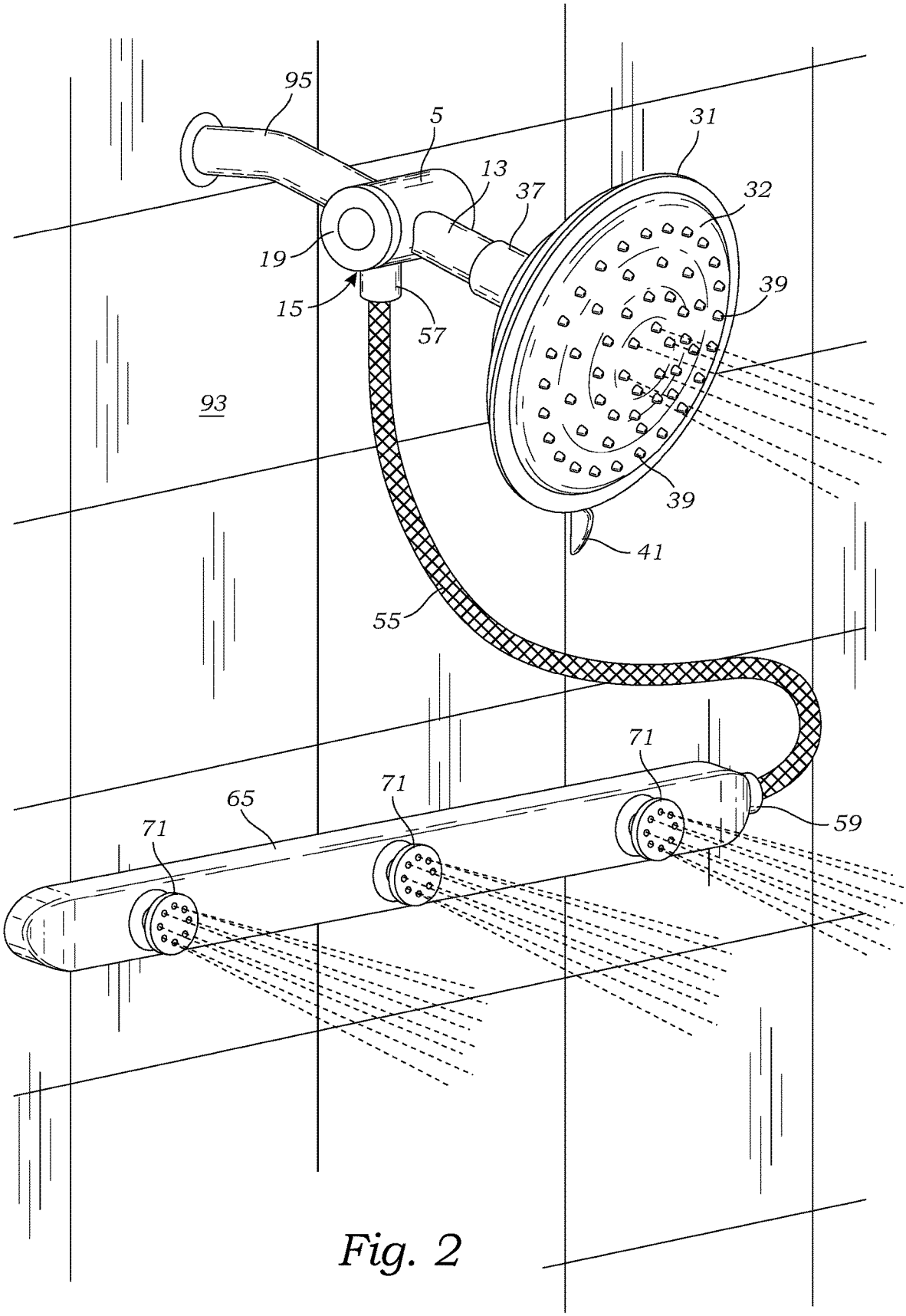
FIG. 2 is a perspective view of the showerhead assembly with the supplemental showerhead mounted to a sidewall in a second orientation.
Figure 3:
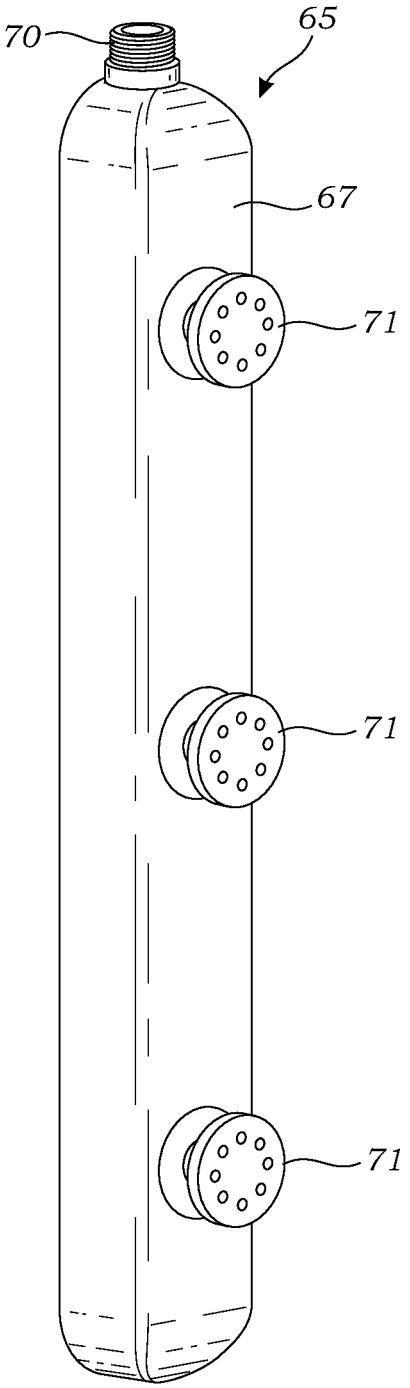
FIG. 3 is a perspective view of a preferred supplemental showerhead.
Figure 4:
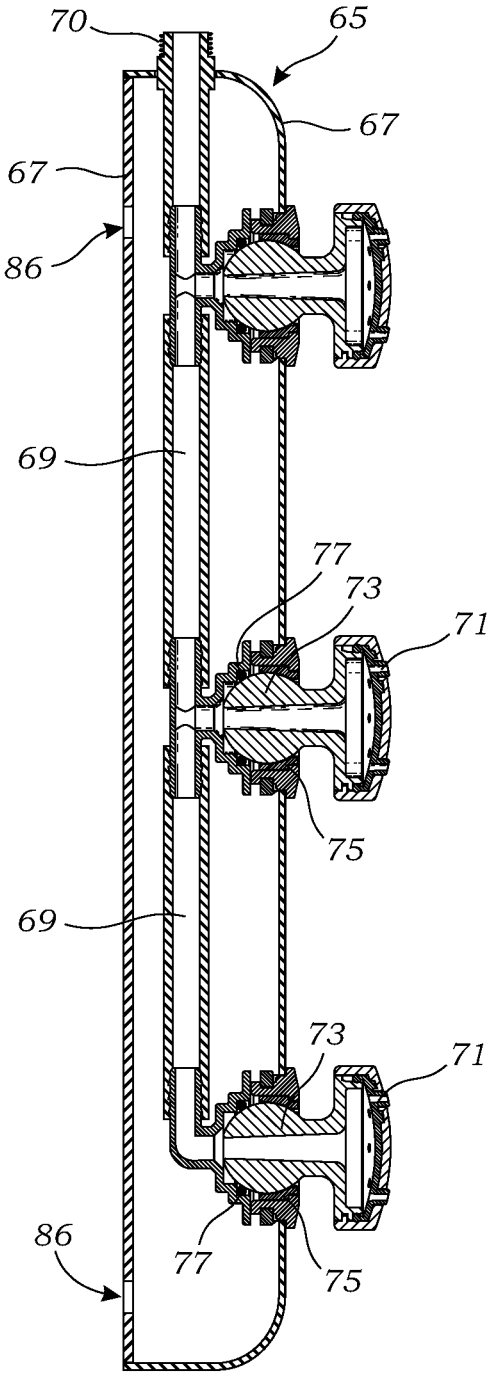
FIG. 4 is a side cutaway view of the supplemental showerhead shown in FIG. 3.
Figure 5:
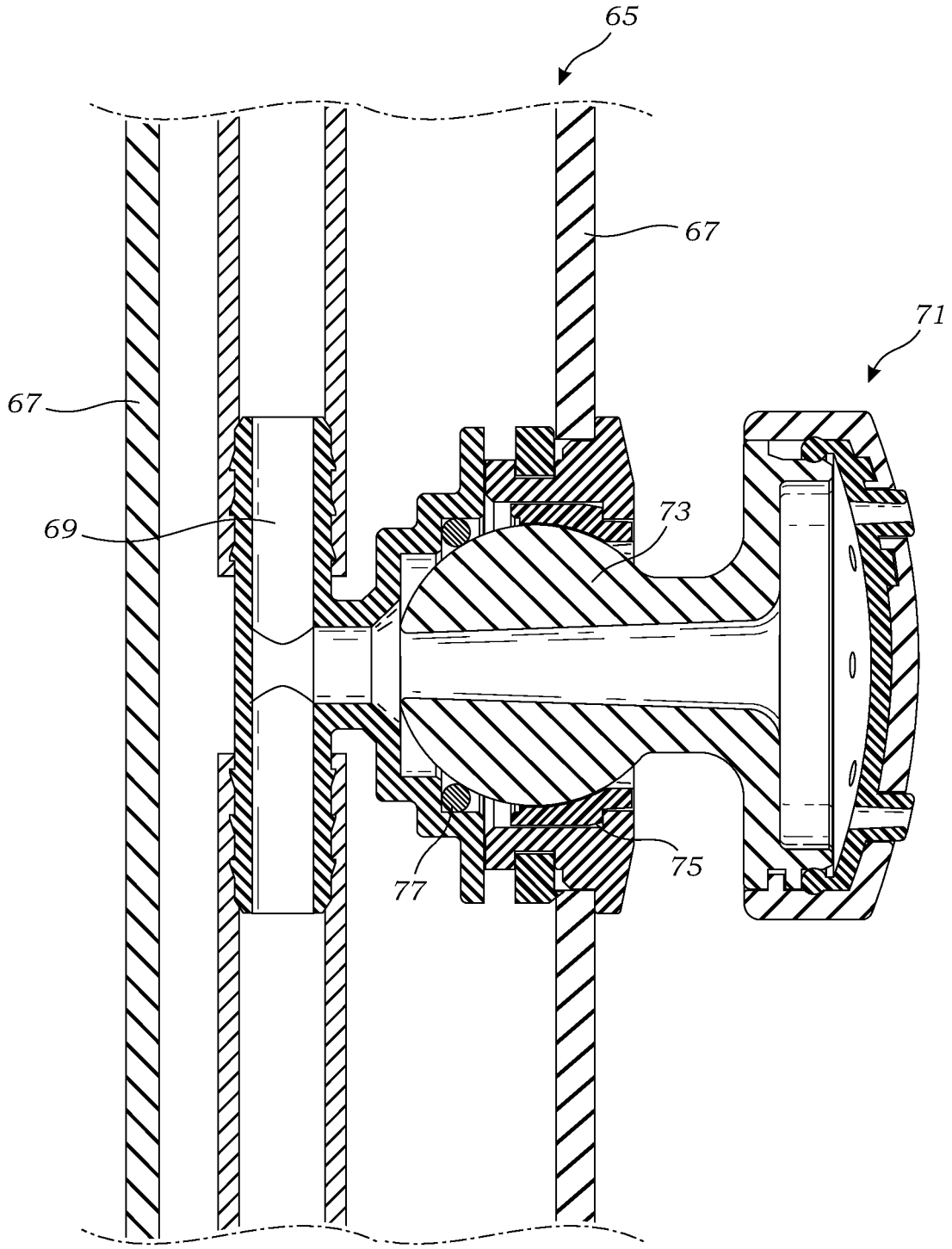
FIG. 5 is a side cutaway view of the supplemental showerhead shown in FIG. 3 illustrating a single nozzle.
Figure 6:
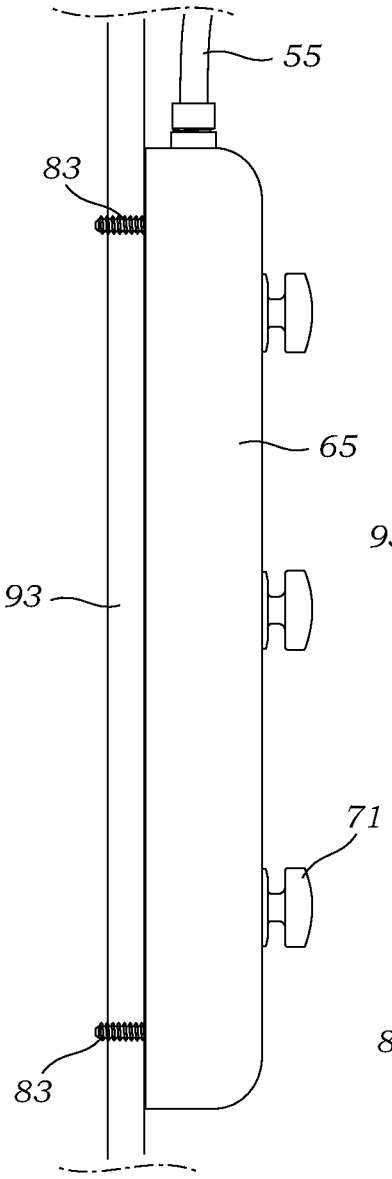
FIG. 6 is side cutaway view of a shower stall wall and side view of the supplemental showerhead illustrating a male threaded fastener affixing the supplemental showerhead to the shower stall sidewall.
Figure 7:
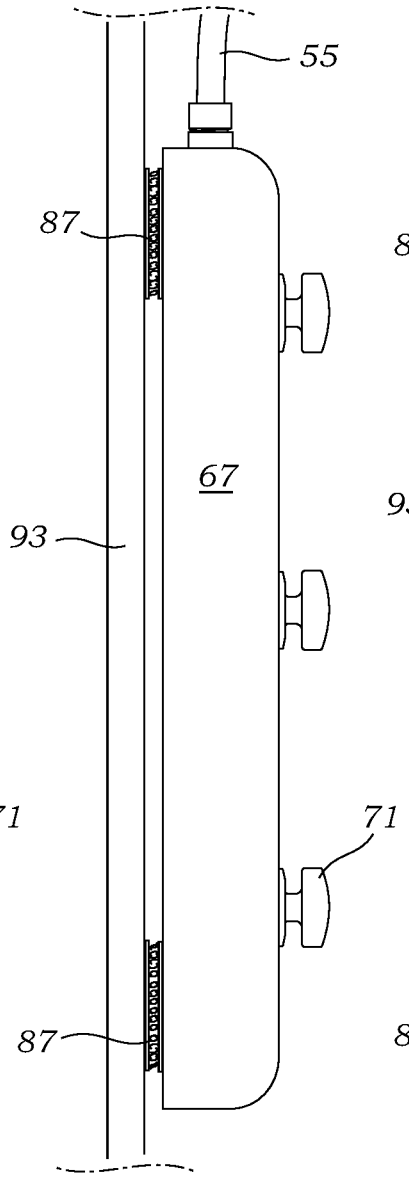
FIG. 7 is side cutaway view of a shower stall wall and side view of the supplemental showerhead illustrating a hook and pile fastener affixing the supplemental showerhead to the shower stall sidewall.
Figure 8:
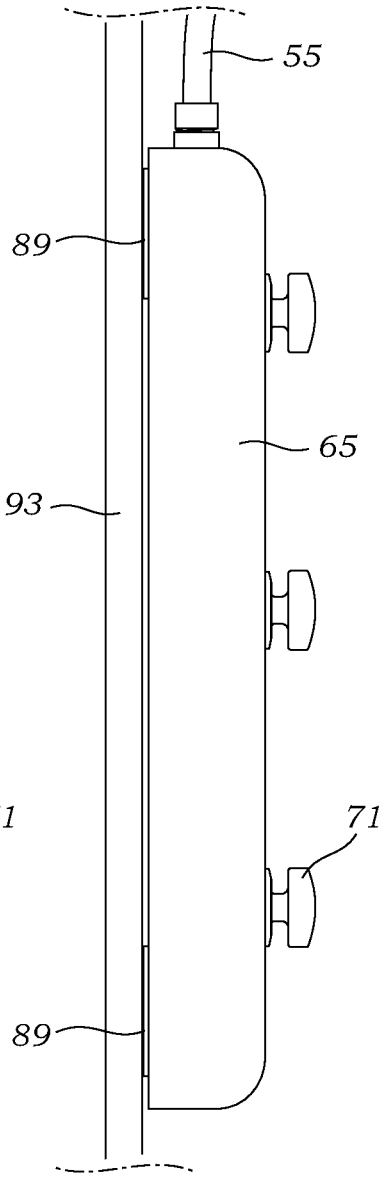
FIG. 8 is side cutaway view of a shower stall wall and side view of the supplemental showerhead illustrating an adhesive fastener affixing the supplemental showerhead to the shower stall sidewall.
Figure 12:
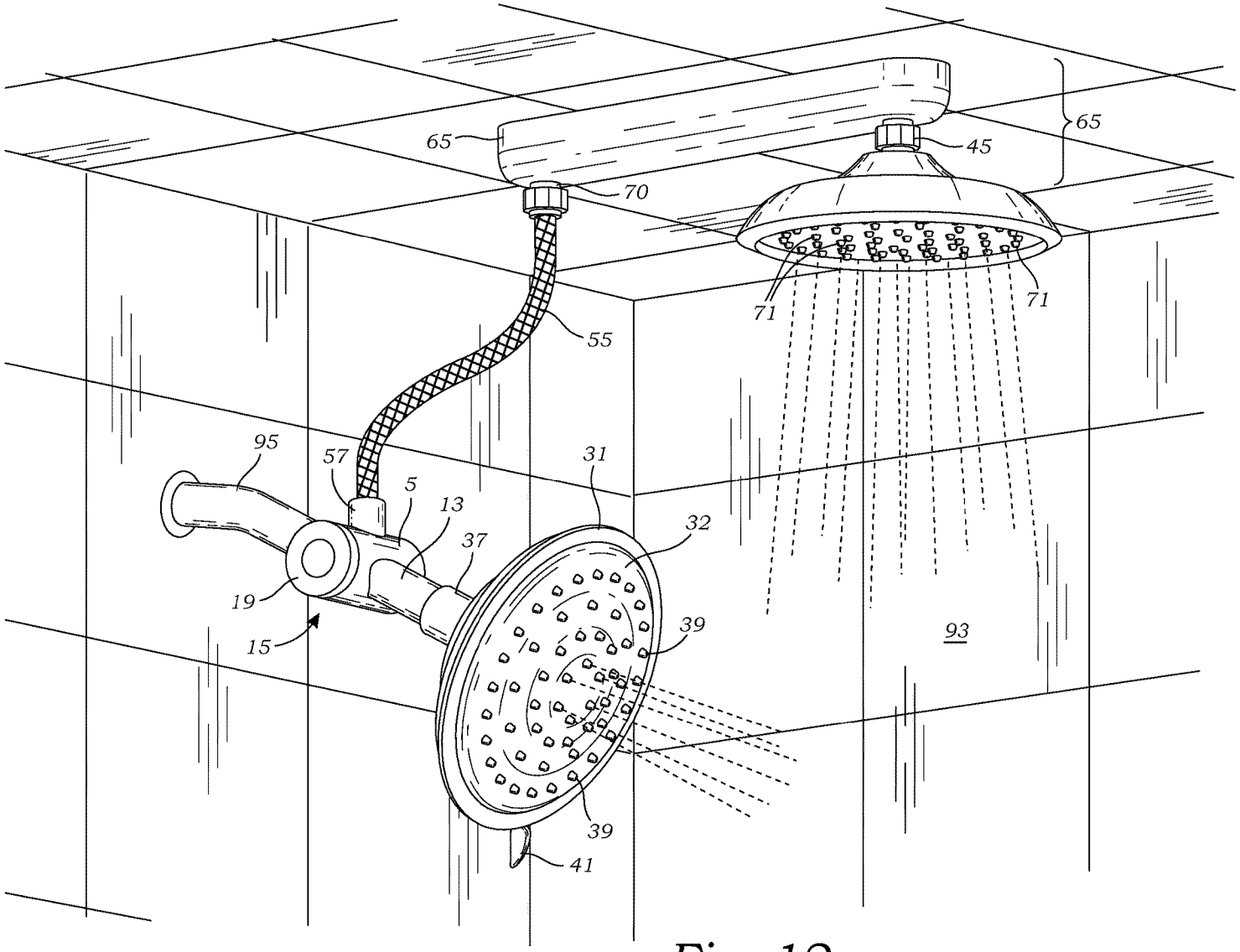
FIG. 12 is a perspective view of the showerhead assembly with a second preferred embodiment of supplemental showerhead mounted to a shower stall ceiling.

As best illustrated in FIGS. 1-2 and 12, the primary showerhead 31 preferably has a traditional construction known to those skilled in the art. For example, as illustrated in the Figures the primary showerhead may include nozzles which have a relatively simple and traditional circular orientation for providing a simply spray pattern. However, the primary showerhead may incorporate more complex features (not shown) for providing selectable and controllable spray patterns. Accordingly, as an example, the primary showerhead 31 may include a controller tab 93 for selectively controlling the flow of water such as to a central conduit 35.

In accordance with the preferred embodiments of the invention, the showerhead assembly's primary showerhead 31 is connected to the diverter's first outlet 13. Preferably, the diverter's first outlet 13 is longitudinally aligned with the diverter's inlet 11 so that the primary showerhead's face 32 is substantially orthogonal to the pipe 95. (See FIGS. 1, 2 and 9-12). As illustrated in FIGS. 9-11, the primary showerhead 31 is preferably connected to the diverter 5 by a ball joint connector 45 wherein the diverter's first outlet 33 includes a hollow ball extension 47, and the proximal end 37 of the primary showerhead includes a socket receptacle 49.

The showerhead assembly 1 includes at least one supplemental showerhead 65. In the preferred embodiment illustrated in the Figures, the showerhead assembly includes only a single supplemental showerhead 65. However, the showerhead assembly may include additional supplemental showerheads of the type described herein. As illustrated in FIGS. 1-5 and 12-14, the supplemental showerhead 65 includes a housing 67 as well as a hollow passageway 69 within the housing 67. In addition, the supplemental showerhead includes one or more nozzles 71 positioned within, or connect to, the housing 67. Each of the nozzles 71 are in fluid communication with the hollow passageway 69.

As illustrated in FIGS. 3-8, in a first preferred sidewall mounted embodiment, the nozzles 71 are affixed within the housing 67 and connected to the passageway 69 by a ball and socket connection which permits the nozzles to pivot multidirectionally. For this embodiment, the nozzles 71 include a ball shaped proximal end 73 positioned within spherical socket 75 formed in the exterior wall of this housing 67. Preferably, each nozzle assembly includes an O-ring 77 providing a fluid-tight seal while allowing the nozzles 71 to pivot in a desired direction. These supplemental showerheads 65 may include any number of nozzles 71. However, in the preferred embodiment illustrated in FIGS. 1-8, the supplemental showerhead 65 possesses three nozzles 71.

Figure 13:
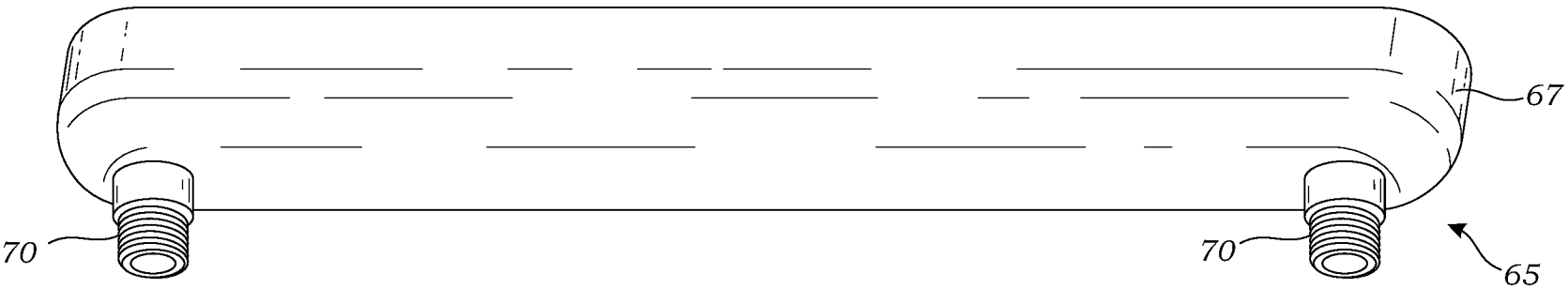
FIG. 13 is a perspective view of a housing for using with the second preferred supplemental showerhead illustrated in FIG. 12.
Figure 14:
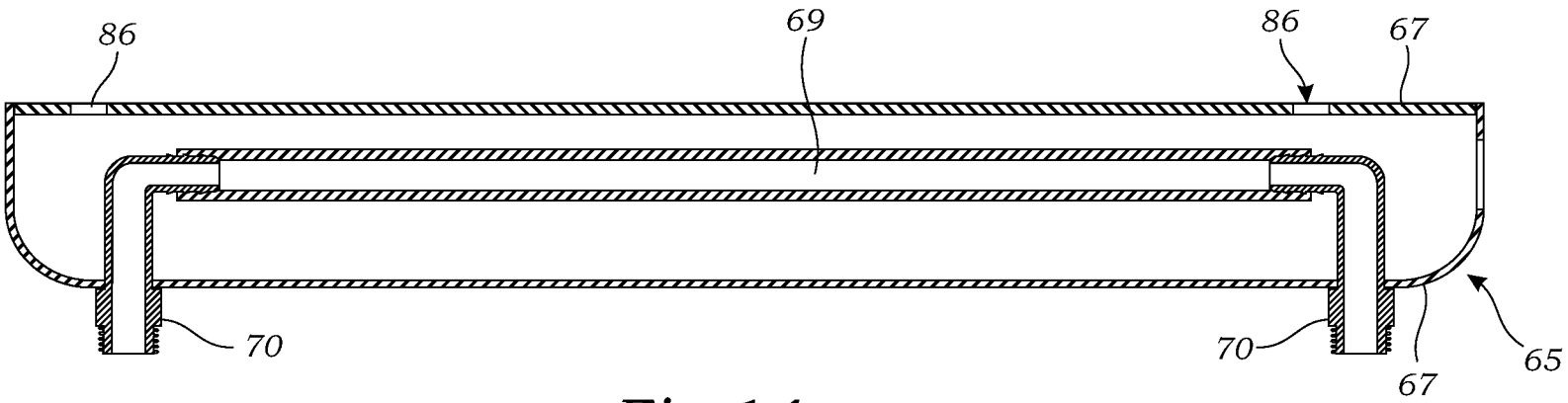
FIG. 14 is a side cutaway view of the housing for using with the second preferred supplemental showerhead illustrated in FIG. 12.

In an alternative embodiment illustrated in FIGS. 12-14, the supplemental showerhead 65 possesses a housing 67 intended to be mounted to the shower stall ceiling. Furthermore, the supplemental showerhead 65 possesses an assembly which is substantially similar to a traditional showerhead including a plurality of nozzles 71 which project from a faceplate which has a relatively simple and traditional circular orientation for providing a simply spray pattern. The faceplate and nozzles are connected to the housing 67 by a ball connector 45.

For each of the embodiments illustrated in FIGS. 1-14, the supplemental showerhead 65 is connected to the diverter 5 by a hollow flexible hose 55. In the preferred embodiment illustrated in the Figures, the hollow flexible hose includes a female threaded first end and a female threaded second end. The flexible hose's first end 57 is connected to the diverter's second outlet 15 which possesses a corresponding male threaded cylindrical construction. Meanwhile, the flexible hose's second end 59 connects to the supplemental showerhead's hollow passageway 69 which possesses a corresponding male threaded cylindrical inlet 70.

As illustrated in FIGS. 1, 2, 6-8 and 12, the showerhead assembly 1 further includes a fastener 83 for affixing the supplemental showerhead 65 to the back wall 93 or ceiling 94 of a shower stall. The supplemental showerhead 65 can be affixed in various positions such as vertically, as illustrated in FIG. 1, or horizontally as illustrated in FIG. 2. This fastener can be of any type as can determined by one skilled in the art. For example, in a first preferred embodiment illustrated in FIG. 6, the fastener includes one or more male threaded screws 85 which project through holes 86 in the supplemental showerhead's housing 67 to engage the shower stall wall 93. In alternative embodiments, the fastener may comprise a hook and loop fastener construction 87 (see FIG. 7) or simple adhesive 89 (see FIG. 8). And in still an additional embodiment not shown, the fastener may comprise one or more magnets incorporated into the supplemental showerhead's housing for affixing magnetically to metal affixed to or integrated into the shower stall wall 93.

While a preferred showerhead assembly has been illustrated and described, it will be apparent that various modifications of the showerhead assembly can be made without departing from the spirit and scope of the invention. Accordingly, it is not intended that the invention be limited except by the following claims.

Having described my invention in such terms so as to enable a person skilled in the art to understand the invention, recreate the invention, and practice it, and having identified the presently preferred embodiments thereof, I claim:

1. A showerhead assembly comprising:
- a hollow diverter having a female threaded inlet, a first outlet, a second outlet, and a valve assembly, said female threaded inlet adapted to attach to a male threaded pipe of a water supply and receive water into said diverter, said first outlet longitudinally aligned with said inlet, and said valve assembly including a rotatable knob connected to a valve which selectively permits or obstructs water from flowing through said first and second outlets;
- a primary showerhead having a central conduit connected to said first outlet for receiving water from said diverter, said primary showerhead having nozzles connected to said central conduit for spraying water;
- a hollow flexible hose having a first end and a second end, said hose's first end connected to said diverter's second outlet to receive water from said diverter for conveyance to said hose's second end;
- a supplemental showerhead having a housing, a hollow passageway within said housing connected to said flexible hose's second end, and one or more nozzles connected to said passageway for spraying water; and
- an adhesive for affixing said supplemental showerhead to a wall.

2. The showerhead assembly of claim 1 further comprising a ball and socket joint connector which connects said primary showerhead to said diverter, said ball joint and socket joint connector which permits said primary showerhead to pivot multi-directionally relative to said diverter.

3. The showerhead assembly of claim 2 wherein at least one of said supplemental showerhead's one or more nozzles is connected to said passageway by a ball and socket joint connector which permits said at least one supplemental showerhead nozzle multidirectional pivoting movement relative to said housing.

4. The showerhead assembly of claim 1 wherein at least one of said supplemental showerhead's one or more nozzles is connected to said passageway by a ball and socket joint connector which permits said at least one supplemental showerhead nozzle multidirectional pivoting movement relative to said housing.

5. The showerhead assembly of claim 1 further comprising a metal plate for being affixed to the wall by said adhesive and a magnet affixed to said supplemental showerhead's housing.

6. A showerhead assembly comprising:
- a wall;
- a pipe connected to a water supply, said pipe projecting through said wall and having a male threaded outlet;

a hollow diverter having a female threaded inlet, a first outlet, a second outlet, and a valve assembly, said female threaded inlet attached to said male threaded pipe of a water supply to receive water into said diverter, said first outlet longitudinally aligned with said inlet, and said valve assembly including a rotatable knob connected to a valve which selectively permits or obstructs water from flowing through said first and second outlets;

a primary showerhead having a central conduit connected to said first outlet for receiving water from said diverter, said primary showerhead having nozzles connected to said central conduit for spraying water;

a hollow flexible hose having a first end and a second end, said hose's first end connected to said diverter's second outlet to receive water from said diverter for conveyance to said hose's second end;

a supplemental showerhead having a housing, a hollow passageway within said housing connected to said flexible hose's second end, and one or more nozzles connected to said passageway for spraying water; and an adhesive which affixes said supplemental showerhead to said wall.

7. The showerhead assembly of claim 6 further comprising a ball and socket joint connector which connects said primary showerhead to said diverter, said ball joint and socket joint connector which permits said primary showerhead to pivot multi-directionally relative to said diverter.

8. The showerhead assembly of claim 7 wherein at least one of said supplemental showerhead's one or more nozzles is connected to said passageway by a ball and socket joint connector which permits said at least one supplemental showerhead nozzle multidirectional pivoting movement relative to said housing.

9. The showerhead assembly of claim 6 wherein at least one of said supplemental showerhead's one or more nozzles is connected to said passageway by a ball and socket joint connector which permits said at least one supplemental showerhead nozzle multidirectional pivoting movement relative to said housing.

10. The showerhead assembly of claim 6 further comprising a metal plate affixed to said wall by said adhesive and a magnet affixed to said supplemental showerhead's housing.

* * * * *